US008644541B2

(12) United States Patent
Lackert et al.

(10) Patent No.: US 8,644,541 B2
(45) Date of Patent: Feb. 4, 2014

(54) METHOD OF INSTALLING A SIGNAL PROCESSING COMPONENT IN A HOUSING OF A HEARING APPARATUS AND HEARING APPARATUS

(75) Inventors: Sebastian Lackert, Veitsbronn (DE); Marco Lederer, Hirschaid/Erlach (DE); Hartmut Ritter, Neunkirchen am Brand (DE); Friedrich Zenk, Hemhofen (DE)

(73) Assignee: Siemens Medical Instruments Pte. Ltd., Singapore (SG)

( * ) Notice: Subject to any disclaimer, the term of this patent is extended or adjusted under 35 U.S.C. 154(b) by 0 days.

(21) Appl. No.: 13/569,346

(22) Filed: Aug. 8, 2012

(65) Prior Publication Data

US 2013/0202139 A1 Aug. 8, 2013

(30) Foreign Application Priority Data

Aug. 8, 2011 (DE) ..... 10 2011 080 609

(51) Int. Cl.
*H04R 25/00* (2006.01)

(52) U.S. Cl.
USPC ..... 381/322; 381/324; 381/330

(58) Field of Classification Search
USPC ..... 381/322, 323, 324, 328, 330, 381, 189; 181/128, 129, 130, 135
See application file for complete search history.

(56) References Cited

U.S. PATENT DOCUMENTS 6,041,128 A * 3/2000 Narisawa et al. ..... 381/322
8,103,032 B2 * 1/2012 Ho et al. ..... 381/324
2012/0033840 A1 2/2012 Goly

FOREIGN PATENT DOCUMENTS

EP 2416595 A1 2/2012

* cited by examiner

*Primary Examiner* — Huyen D Le

(74) *Attorney, Agent, or Firm* — Laurence A. Greenberg; Werner H. Stemer; Ralph E. Locher

(57) ABSTRACT

A hearing apparatus and in particular a hearing aid are to be optimized as regards the risk of feedback. The hearing apparatus contains a housing, having a first opening and a second opening, and with a frame, in or on which a signal processing component is attached, and which can be inserted into the first opening of the housing as far as an end position. A ramp is disposed in the housing which interacts with the frame such that the frame is also moved perpendicular to the direction of insertion toward the second opening during insertion into the housing along a direction of insertion only in one section as far as the end position, which is less than 30% of the insertion path from the first opening to the end position.

12 Claims, 3 Drawing Sheets

METHOD OF INSTALLING A SIGNAL PROCESSING COMPONENT IN A HOUSING OF A HEARING APPARATUS AND HEARING APPARATUS

CROSS-REFERENCE TO RELATED APPLICATION

This application claims the priority, under 35 U.S.C. §119, of German application DE 10 2011 080 609.1, filed Aug. 8, 2011; the prior application is herewith incorporated by reference in its entirety.

BACKGROUND OF THE INVENTION

Field of the Invention

The present invention relates to a hearing apparatus with a housing, having a first opening and a second opening, and with a frame, in or on which a signal processing component is attached and which can be inserted into the first opening of the housing as far as an end position. Additionally the present invention relates to a method for installing a frame with a signal processing component in a housing of a hearing apparatus, having a first opening and a second opening, in that the frame is pushed into the first opening of the housing as far as an end position. The term "hearing apparatus" here refers to any device triggering a hearing stimulus which can be worn in or on the ear, in particular a hearing aid, a headset, headphones, etc.

Hearing aids are wearable hearing apparatuses used to assist the hard-of-hearing. To cope with the numerous individual requirements, different designs of hearing aids such as behind-the-ear hearing aids (BTE), hearing aids with an external receiver (RIC: receiver in the canal) and in-the-ear hearing aids (ITE), e.g. including concha hearing aids or canal hearing aids (ITE, CIC), are provided. The hearing aids listed by way of example are worn on the outer ear or in the auditory canal. Bone conduction hearing aids, implantable or vibrotactile hearing aids are however additionally available on the market. In these, damaged hearing is stimulated either mechanically or electrically.

The general components of hearing aids are in principle an input converter, an amplifier and an output converter. The input converter is generally a sound receiver, e.g. a microphone, and/or an electromagnetic receiver, e.g. an induction coil. The output converter is usually implemented as an electroacoustic converter, e.g. a miniature loudspeaker, or as an electromechanical converter, e.g. a bone conduction receiver. The amplifier is normally integrated into a signal processing unit. This basic structure is illustrated in FIG. 1 using the example of a behind-the-ear hearing aid. In a hearing aid housing 1 for wearing behind the ear one or more microphones 2 are incorporated to receive sound from the environment. A signal processing unit 3, which is likewise integrated into the hearing aid housing 1, processes the microphone signals and amplifies them. The output signal from the signal processing unit 3 is transmitted to a loudspeaker or receiver 4, which emits an acoustic signal. The sound is if appropriate transmitted via a sound tube, which is fixed in the auditory canal using an otoplastic, to the eardrum of the wearer of the device. The hearing aid and in particular the signal processing unit 3 is supplied with energy by a battery 5 likewise integrated into the hearing aid housing 1.

Hearing aids are sensitive to dust and water, which can penetrate into microphone openings. Hence the microphone inputs are in many cases protected by membranes. These membranes are generally welded onto the housing shell of the hearing aid.

Housing shells are often shaped like a bottle. A frame is inserted into a bottle-shaped housing of this type, and supports a plurality of signal processing components such as microphones, amplifiers and receivers. Using this strategy of inserting a frame into a bottle-shaped housing it is not easy to create a soundproof connection between the frame and the housing shell in the region of the microphones. There is a particular need to prevent, for example, sound reaching the microphone(s) from the receiver via the inner chamber of the housing. A small gap between frame and housing would very probably lead to feedback or for example would impair the directionality of a microphone system.

SUMMARY OF THE INVENTION

It is accordingly an object of the invention to provide a method of installing a signal processing component in a housing of a hearing apparatus and a hearing apparatus which overcome the above-mentioned disadvantages of the prior art methods and devices of this general type, in which a signal processing component attached to a frame can be suitably installed at an opening of a housing.

According to the invention the object is achieved by a hearing apparatus with a housing, having a first opening and a second opening, and with a frame, in or on which a signal processing component is attached and which can be inserted into the first opening of the housing as far as an end position. A ramp is arranged in the housing which interacts with the frame such that the frame is also moved perpendicular to the direction of insertion toward the second opening during insertion into the housing along a direction of insertion only in one section as far as the end position, which is less than 30% of the insertion path from the first opening to the end position. The signal processing component is fixed in the end position in a soundproof manner in respect of the inner chamber of the housing at the second opening.

Additionally inventively provided is a method for installing a frame with a signal processing component in a housing of a hearing apparatus, having a first opening and a second opening, by inserting the frame into the first opening of the housing as far as an end position. The frame also being moved perpendicular to the direction of insertion toward the second opening during insertion into the housing along a direction of insertion by a ramp in the housing only in one section as far as the end position, which is less than 30% of the insertion path from the first opening to the end position, the signal processing component being fixed in the end position in soundproof manner in respect of the inner chamber of the housing at the second opening.

Advantageously a ramp is thus disposed in the housing, which deflects an insertion movement of the frame such that the insertion movement receives a movement component at the end of the insertion process which is perpendicular to the initial direction of insertion. As a result, in particular in the case of bottle-shaped housings, components can be positioned at locations in a way which would not be possible using a purely linear insertion movement.

It is particularly advantageous if the signal processing component is fixed in the end position in a soundproof manner in respect of the inner chamber of the housing at the second opening. The soundproofing is here achieved in that the frame is pressed onto the housing in the region of the second opening by the movement component perpendicular to the direction of insertion. In this way acoustic feedback via the inner chamber of the housing can be prevented.

The effect of the ramp relies on the fact that by using a lead angle not only is a movement along a direction of insertion "translated" into a movement in a perpendicular direction to the direction of insertion, but an action of force along a direction of insertion is translated into an action of force in a perpendicular direction to the direction of insertion. Because of the lever principle the resultant normal force can be adjusted by the ratio of the two paths—insertion path and normal movement thereto—as a function of an insertion force. In other words, the smaller the lead angle or the flatter the ramp, the stronger the action of force and here the exerted pressure of the frame introduced into the housing onto an inner wall of the housing accommodating the frame.

Preferably the section or the ramp is shorter than 10% of the insertion path. This has the advantage that the deflection of the insertion movement only takes place shortly before the end position of the frame.

In an advantageous embodiment the ramp is implemented by means of a wedge that can be inserted into the housing. A solution such as this makes it easy to replace the wedge or the ramp. As a result, any fatigue in the material of the ramp during use or if the hearing apparatus undergoes maintenance can be offset.

In another particularly advantageous embodiment the ramp is designed in one piece with the housing. Such a design is particularly stable and as a result can absorb greater forces.

The signal processing component can be a microphone. It is then possible to position the microphone using the additional movement component perpendicular to the direction of insertion as close as possible to the second opening (sound inlet opening). Otherwise, if the signal processing component is a switch, for example, this can be pressed by the movement perpendicular to the direction of insertion into a opening, the opening edge of which spans a plane essentially parallel to the direction of insertion.

The signal processing component can also be put into a pouch. This isolates the signal processing component from the frame. In particular a microphone as a signal processing component can thus be acoustically isolated from the frame.

Specifically the pouch can be formed in one piece with the sealing element. In this way the installation of the hearing apparatus can be simplified, as two separate components do not have to be installed.

Additionally it is an advantage if the sealing element is made of a rubber-like or foam-like material. As a result, a soundproof connection can generally be reliably created. A material of this type does have a high coefficient of friction and would produce strong resistance on the housing during insertion of the frame, but because the frame with the sealing element is not pressed into contact until the last phase of the insertion, virtually no resistance arises as a result of the sealing element during insertion.

A membrane can also be disposed at the second opening. Such a membrane keeps dirt and water away from the signal processing component positioned below the second opening.

Thus the signal processing components attached to the frame can be installed in a particularly suitable manner at an opening of the housing, the signal processing components being fixed in the end position in soundproof manner in respect of the inner chamber of the housing at the second opening. In this way acoustic feedback via the inner chamber of the housing as well as soiling of the inner chamber of the housing are prevented.

Other features which are considered as characteristic for the invention are set forth in the appended claims.

Although the invention is illustrated and described herein as embodied in a method of installing a signal processing component in a housing of a hearing apparatus and a hearing apparatus, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
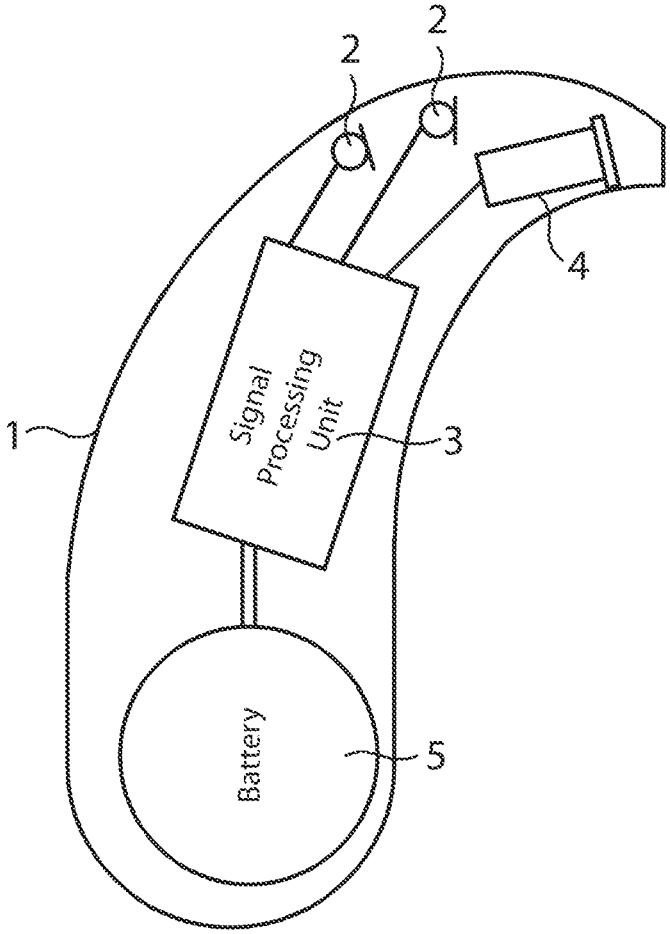
FIG 1 PRIOR ART
FIG. 1 is an outline illustration of a hearing aid according to the prior art.

The exemplary embodiments depicted below represent preferred embodiments of the present invention. Components having the same action are provided with the same reference characters.

Figure 2:
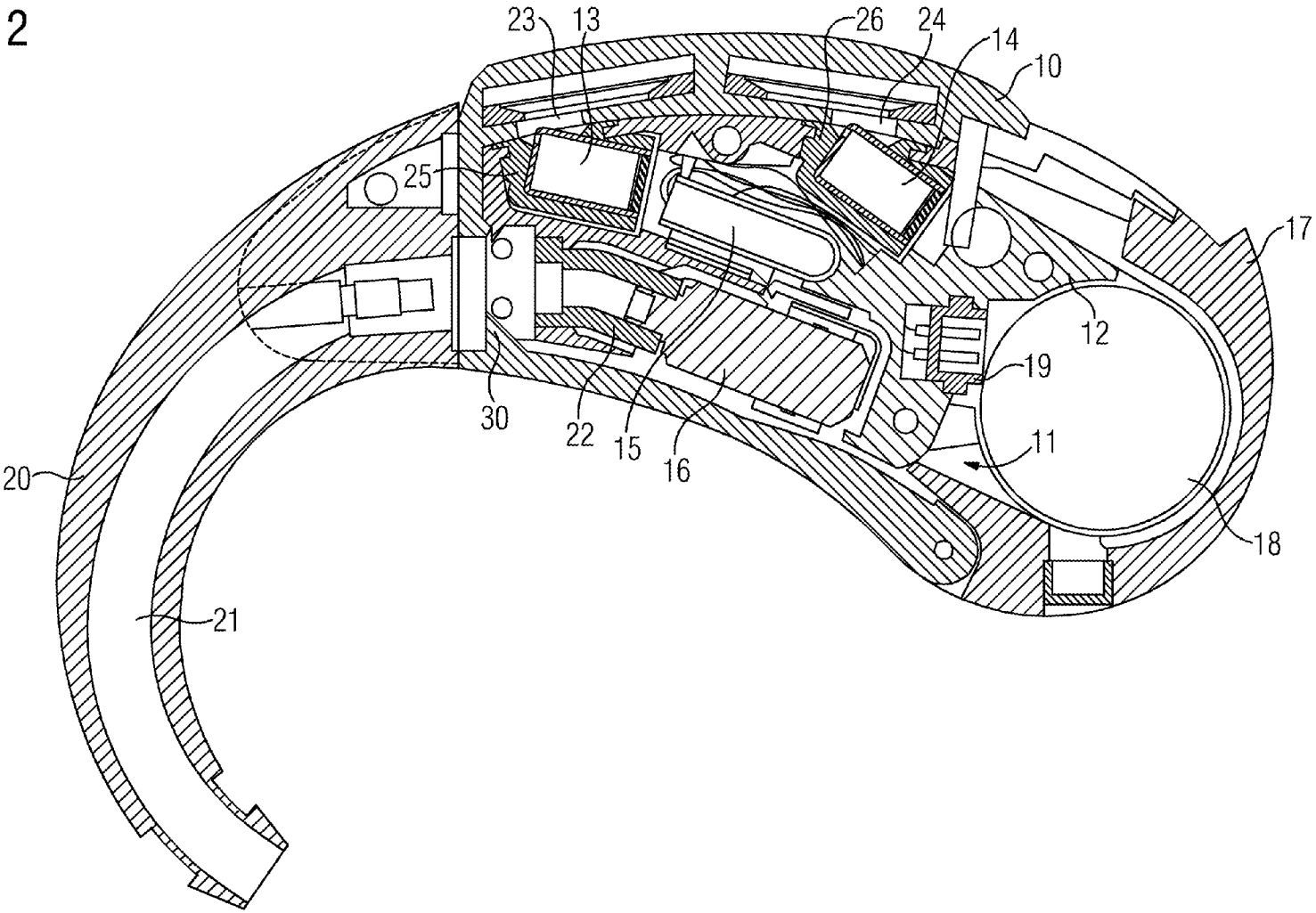
FIG. 2 is a diagrammatic, longitudinal sectional view through a hearing aid according to the invention.

Referring now to the figures of the drawing in detail and first, particularly, to FIG. 2 thereof, there is shown a hearing aid which possesses a housing 10, which has a bottle-shaped design. "Bottle-shaped" here also means the shape of a beaker or the like.

The bottle-shaped housing 10 possesses an opening 11, into which a frame 12 is inserted. The frame 12 acts as a support for numerous signal processing components of the hearing aid. In the present example such signal processing components are microphones 13 and 14, an amplifier electronic circuit 15 and a receiver 16. The frame 12 can additionally also support other components. Examples that can be mentioned here are switches, battery, sound canals and the like.

The first opening 11 of the bottle-shaped housing 10 is here closed by a battery cover 17. A battery 18 is mounted in the battery cover 17. Connection elements 19 for the battery 18 are likewise integrated into the frame 12.

A support hook 20 is fixed to the side of the bottle-shaped housing 10 opposite the battery cover 17. The support hook 20 has a sound canal 21, into which sound is coupled from the receiver 16 via a receiver connector 22.

When installing the hearing aid the frame 12 is first fitted with the signal processing components 13, 14, 15, 16, etc. Then the fitted frame 12 is inserted into the bottle-shaped housing 10. Finally the battery 18 is inserted and the battery cover 17 closed.

An important aspect of the satisfactory functionality of the hearing aid is that among other things there is as little feedback as possible from the receiver 16 inside the housing 10 to the microphones 13, 14. However, this means that the outlets of the microphones 13, 14 must be sealed in as soundproof a manner as possible in respect of the inner chamber of the housing 10.

Similar sealing problems in respect of soiling and water occur if operating or display elements are to be disposed on the hearing aid, which are first attached to the frame 12. To create a seal it is in fact necessary or at least desirable for a sealing element to be provided at the corresponding housing opening.

In the present example each of the microphones 13, 14 is surrounded by a pouch 25, 26 made of a rubber-like material. The function of these pouches 25, 26 is to hold the microphones 13, 14 acoustically damped in the frame 12. In the present case the pouches 25, 26 have, as becomes clear in the enlarged view in FIG. 3, a circular sealing lip as a sealing element 27, which projects out over the surface of the frame 12 and is pressed by a corresponding frame collar 28 onto a housing section 29 which surrounds the opening 23.

If the frame 12 is now inserted into the bottle-shaped housing 10 and the frame 12 is pushed along close to the inner wall of the housing 10, the rubber-like sealing lip would be displaced or damaged during insertion. Hence it is inventively provided that the frame 12 is moved by a ramp 30, which is disposed inside the housing 10 on the base thereof opposite the opening 11, at the end of the insertion movement in the direction of the opening 23 (second opening) for the signal processing component or the microphone 13. In the present example the ramp 30 is configured in one piece with the housing 10.

The frame 12 is inserted into the bottle-shaped housing 10 initially via the basic insertion path along a direction of insertion 31 which runs essentially parallel to a center line of the interior of the housing. In the present example somewhat more than 90% of the insertion path initially runs along this direction of insertion 31. Not until the end of the insertion does the frame 12 encounter the ramp 30. The ramp 30 has here by way of example a surface 32, which runs at an angle of approximately 30° in respect of an inner wall 33 of the housing 10. The frame 12 has a corresponding chamfer 34, so that the insertion movement is here at least partially deflected upward to the opening 23. Thanks to the ramp 30 the insertion movement receives a component 35 perpendicular to the direction of insertion 31. As a result the frame 12 including the sealing lip 27 is pressed onto the inner wall of the housing 10 opposite the ramp 30 in the region of the opening 23.

The angle of the surface 32 of the ramp 30 in respect of the housing inner wall 33 and the length of the ramp 30 in the direction of insertion 31 at least help to define the contact pressure of the frame 12 in respect of the housing inner wall. The desired contact pressure can thus be adjusted using the angle and the length. The contact pressure is decisive for the quality of the soundproofing of the microphone 13 in respect of the inner chamber of the housing. The soundproofing in turn determines the acoustic stability and/or quality of the directional characteristics of the microphone system. Additionally thanks to the ramp 30 the section of the frame 12 which is at the front during the insertion is locked in the end position, in which the frame 12 is fully inserted into the housing, resulting in higher mechanical stability.

For the insertion it is favorable if the frame 12 has smaller dimensions transversely to the direction of insertion 31 than the inner chamber of the housing 10. As a result the sealing element 27 or the sealing lip does not rub against the housing inner wall during insertion, so that this is not displaced or damaged and the insertion force can remain low.

Figure 3:
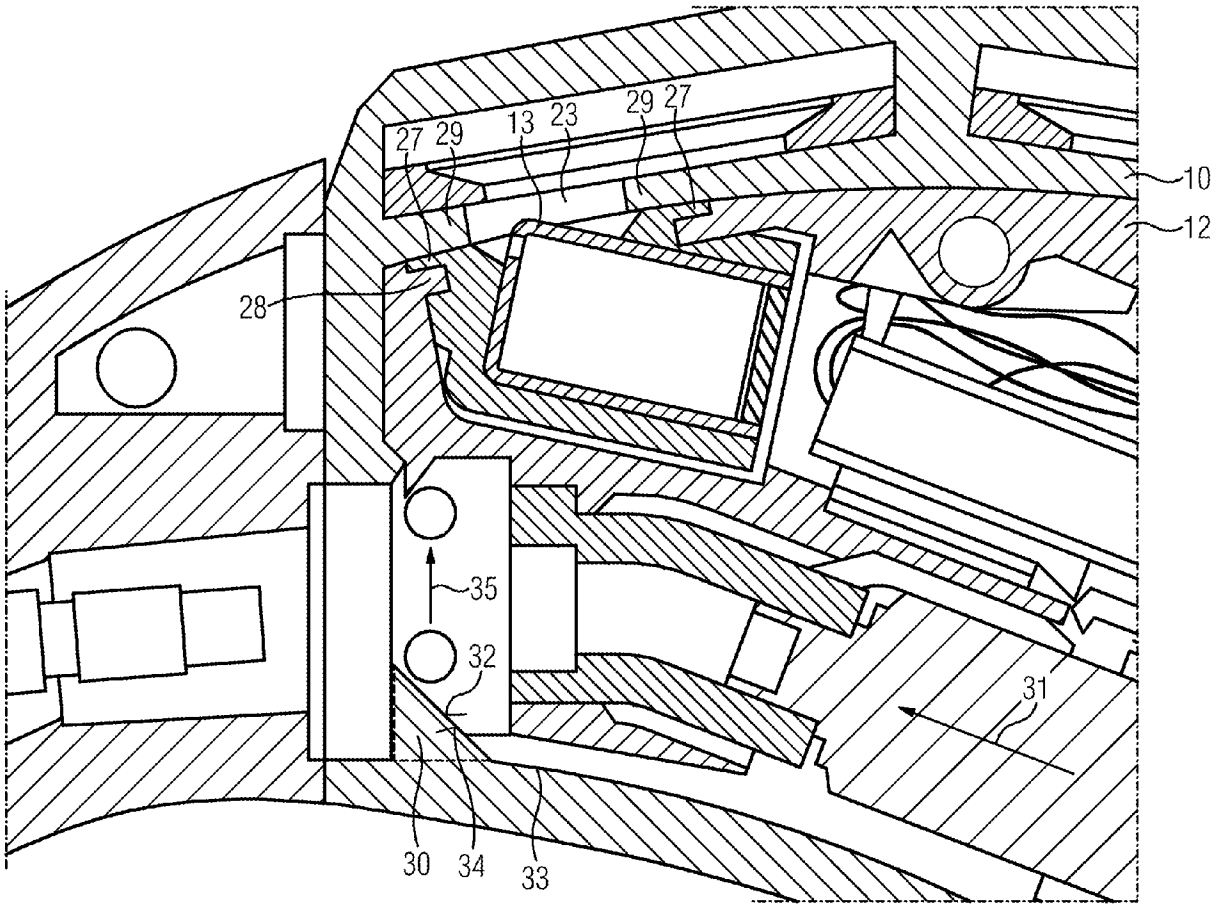
FIG. 3 is an enlarged sectional view of the image from FIG. 2.

In another advantageous embodiment the ramp 30 is formed from a wedge introduced into the housing 10. The ramp 30 formed by the wedge is indicated in FIG. 3 by a dotted line. A particular advantage of such a "retrofittable and replaceable" wedge lies in the possibility of a choice of material and the shape and dimensions of the wedge. Thus relevant mechanical properties of the ramp 30 or of the wedge can easily be determined.

As a result the desired contact pressure of the frame 12 onto the housing inner wall 33 can be adjusted as required. The material of the wedge (flexible or rigid), the inclination of the ramp 30 formed by the wedge (flat or steep), as well as the size of the wedge here determine the contact pressure of the frame 12 onto the housing 10, so that an optimum soundproof connection between the frame 12 and the housing inner wall 33 can be achieved in the region of the microphones 13, 14.

Depending on whether a fixed or movable wedge is desired, it can be permanently fixed in a preferred embodiment, for example glued in, welded in or the like.

In an alternative embodiment the wedge can be introduced loose into the housing. Because the front section of the frame 12 is "wedged together" in a self-locking manner with the wedge 30 located in the housing 10, both the wedge forming the ramp 30 and the frame 12 can be held permanently in position. Such a wedge can easily be replaced or exchanged.

It may be expedient to manufacture the wedge according to another embodiment as a frame (not shown here), the more so because as a result material is thereby saved and the weight of the hearing apparatus is reduced. Accordingly the convenience of wearing the hearing apparatus can be improved. Additionally the mechanical properties of this frame 12 can also be influenced by a purposeful choice of the thicknesses of its walls.

In another simple embodiment the ramp 30 and/or the wedge is configured to be flexible. This can be achieved either by the suitable choice of the material of the wedge and/or by its implementation as a frame—see above. Thus not only can the desired contact pressure be adjusted, but simultaneously the material of the hearing apparatus can also be optimally preserved.

The above example relates to a behind-the-ear hearing aid. The inventive concept can however also be used for example for in-the-ear hearing aids or other hearing apparatuses.

In an advantageous manner a higher acoustic stability and a higher amplification can be achieved by the inventive concept, especially in the case of directional microphones, in particular if devices having a bottle-shaped housing and inserted frame are constructed. The users of these hearing apparatuses benefit thereby in particular as regards speech comprehensibility and sound impression.

The invention claimed is:

1. A hearing apparatus, comprising:

a housing having a first opening formed therein and a second opening formed therein, said housing defining an inner chamber;

a signal processing component;

a frame, in or on which said signal processing component is attached and said frame being inserted into said first opening of said housing as far as an end position; and a ramp disposed in said housing and interacting with said frame such that said frame is also moved perpendicular to a direction of insertion toward said second opening during insertion into said housing along the direction of insertion only in one section as far as the end position, which is less than 30% of an insertion path from said first opening to the end position, said signal processing component being fixed in the end position in a soundproof manner in respect of said inner chamber of said housing at said second opening.

2. The hearing apparatus according to claim 1, wherein said one section as far as the end position being less than 10% of the insertion path.

3. The hearing apparatus according to claim 1, wherein said ramp being implemented with a wedge which can be inserted into said housing.

4. The hearing apparatus according to claim 1, wherein said ramp is configured in one piece with said housing.

5. The hearing apparatus according to claim 3, wherein said ramp is configured to be flexible.

6. The hearing apparatus according to claim 1, wherein said signal processing component is a microphone.

7. The hearing apparatus according to claim 1, further comprising a sealing element disposed on said frame, said sealing element in the end position of said frame presses against said housing at said second opening, so that said signal processing component is connected in a soundproof manner to said second opening.

8. The hearing apparatus according to claim 7, further comprising a pouch, said signal processing component being introduced into said pouch.

9. The hearing apparatus according to claim 8, wherein said pouch is formed in one piece with said sealing element.

10. The hearing apparatus according to claim 8, wherein said pouch is formed from a rubber material.

11. The hearing apparatus according to claim 1, further comprising a membrane disposed at said second opening.

12. A method for installing a frame with a signal processing component in a housing of a hearing apparatus, the housing having a first opening formed therein and a second opening formed therein, which comprises the steps of:

inserting the frame into the first opening of the housing as far as an end position, the frame also being moved perpendicular to a direction of insertion toward the second opening during insertion into the housing along the direction of insertion by a ramp in the housing only in one section as far as the end position, which is less than 30% of an insertion path from the first opening to the end position; and fixing the signal processing component in the end position in a soundproof manner in respect of an inner chamber of the housing at the second opening.

* * * * *